US007306136B2

(12) United States Patent
McKenna et al.

(10) Patent No.: US 7,306,136 B2
(45) Date of Patent: Dec. 11, 2007

(54) HANDLED CONTAINER

(75) Inventors: David J. McKenna, Plainfield, IL (US); Jeffrey M. Gardner, West Chicago, IL (US)

(73) Assignee: Weyerhaeuser Company, Federal Way, WA (US)

( * ) Notice: Subject to any disclaimer, the term of this patent is extended or adjusted under 35 U.S.C. 154(b) by 0 days.

(21) Appl. No.: 11/392,015

(22) Filed: Mar. 29, 2006

(65) Prior Publication Data

US 2007/0228120 A1 Oct. 4, 2007

(51) Int. Cl.
*B65D 5/462* (2006.01)
*B65D 5/32* (2006.01)

(52) U.S. Cl. ..... 229/117.13; 229/122.24; 229/143

(58) Field of Classification Search ..... 229/117.12, 229/117.13, 117.14, 117.22, 122.24, 122.26, 229/143, 190, 193, 154
See application file for complete search history.

(56) References Cited

U.S. PATENT DOCUMENTS 1,584,972 A * 5/1926 Bliss ..... 229/122.26
1,809,853 A * 6/1931 Knowlton ..... 493/59
1,892,594 A * 12/1932 Stone ..... 229/190
2,276,820 A * 3/1942 Bonfield ..... 229/143
3,194,480 A * 7/1965 Maindron ..... 229/117.22
3,255,950 A * 6/1966 Marcouly et al. ..... 229/117.13
3,586,233 A * 6/1971 McCulloch ..... 229/143
3,704,823 A * 12/1972 Howe ..... 229/143
4,062,487 A * 12/1977 Bliss ..... 229/117.13
4,154,388 A * 5/1979 Hall ..... 229/193
4,221,294 A * 9/1980 Burgess ..... 229/193
4,913,340 A * 4/1990 Ilitch ..... 229/143
5,018,663 A * 5/1991 Corso ..... 229/117.13
5,065,937 A * 11/1991 Ritter ..... 229/117.13
6,378,733 B1 * 4/2002 Boonzaier ..... 229/117.13

FOREIGN PATENT DOCUMENTS

FR 2550764 A1 * 2/1985 ..... 229/117.14

* cited by examiner

*Primary Examiner*—Gary E Elkins

(57) ABSTRACT

A container has opposed pairs of parallel walls. There are closure members attached to the upper side of one pair of walls which extend downwardly into the container. Handle members attached to the closure members. The handle members are contiguous in the formed container and have aligned hand holes. The upper sides of the handle members are below or at the top of the container. Closure panels are attached to the upper sides of the other pair of walls. The closure panels are attached to the first pair of walls and are over the closure and handle members. The closure panels form an opening to grasp the hand holes.

14 Claims, 3 Drawing Sheets

HANDLED CONTAINER

This is directed to a container having a handle.

Many containers have handles. The handles usually are on the top of the container and extend outwardly from the top of the container. This makes it difficult to stack the containers on pallets, in warehouses, or on store shelves.

In an embodiment of this invention there is provided a container that has an integral handle and that is stackable. In an embodiment of this invention there is provided a container that has a recessed integral handle and that may be used for liquids. In an embodiment of this invention there is provided a container that has a recessed integral handle and that may be used for dry goods. These embodiments may be made from several embodiments of container blanks.

It is possible, using any of the embodiments of this invention, for a supplier to stack handled container on pallets, for a store to stack handles containers on shelves and for customers to pick these containers from the shelves easily.

In this disclosure the walls, panels and members have sides which may be denoted by an edge or by a score line.

Figure 1:
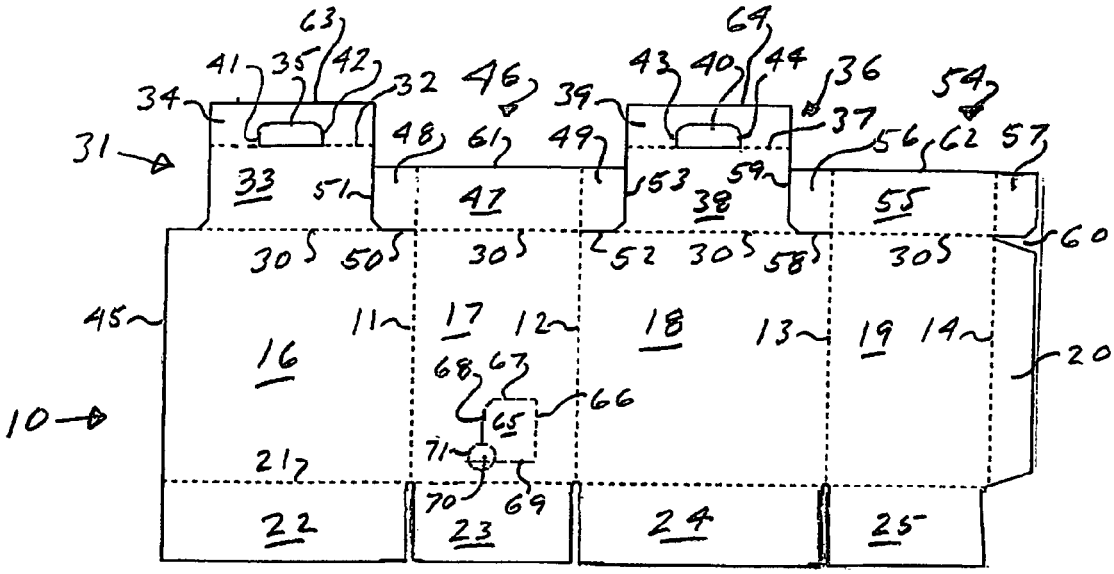
FIG. 1 is a top plan view of a blank for one embodiment of the invention.
Figure 2:
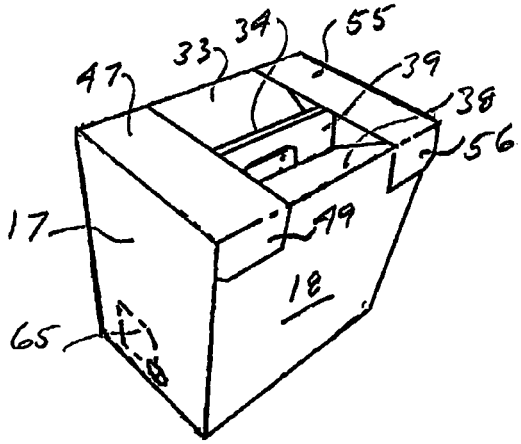
FIG. 2 is an isometric view of the container made from the blank of FIG. 1.

One embodiment of the invention is shown in FIGS. 1 and 2. FIG. 1 shows the blank and FIG. 2 shows the container made from the blank.

The blank 10 is divided by transverse score lines 11, 12, 13 and 14 into walls 16, 17, 18 and 19, and attachment panel 20. The transverse score lines 11, 12, 13 and 14 are substantially parallel. Longitudinal score line 21 divides the walls 16, 17, 18 and 19 from the bottom closure panels 22, 23, 24 and 25. Score line 21 is substantially perpendicular to the score lines 11, 12, 13 and 14. The longitudinal score line 21 on the walls 17 and 19 may be slightly offset from the score line 21 on the walls 16 and 18 to allow the bottom closure panels 23 and 25 to be under or over the bottom closure panels 22 and 24 when the container is formed. Transverse slots 26, 27 and 28 are aligned with score lines 11, 12 and 13, respectively, and separate the bottom closure panels from each other.

A longitudinal score line 30 divides the walls 16, 17, 18 and 19 from the upper securing and handle panels. The longitudinal score line 30 is substantially perpendicular to transverse score lines 11, 12, 13 and 14. The longitudinal score line 30 on the walls 17 and 19 may be slightly offset from the longitudinal score line 30 on the walls 18 and 20 if needed for the closure of the container.

The width of wall 16 is the distance between the outer side 45 of wall 16 and score line 11. The width of wall 18 is the distance between score lines 12 and 13. The width of wall 16 is substantially equal to the width of wall 18.

The width of wall 17 is the distance between score line 11 and score line 12. The width of wall 19 is the distance between score line 13 and score line 14. The width of wall 17 is substantially equal to the width of wall 19.

Handle panel 31 is attached to wall 16 by the score line 30. Handle panel 31 is divided by a score line 32 into a closure member 33 attached to wall 16 by the score line 30 and a handle member 34 attached to the outer side of the closure member 33 by the score line 32. A hand hole 35 is located in the handle member 34. The hand hole 35 may have its inner side on the score line 32, as shown, or it may be within the handle member 34.

Handle panel 36 is attached to the wall 18 by the score line 30. Handle panel 36 is divided by a score line 37 into a closure member 38 attached to the wall 18 by the score line 30 and a handle member 39 attached to the outer side of the closure member 38 by the score line 37. A hand hole 40 is located in the handle member 39. The hand hole 40 may have its inner side on the score line 37, as shown, or it may be within the handle member 39.

The hand holes 35 and 40 are so located in their respective handle panels 31 and 36 that they will form a unitary hand hole in the erected container. The distance between the score line 11 and the side 42 of hand hole 35 which is nearest score line 11 is substantially equal to the distance between score line 12 and the side 43 of hand hole 40 which is nearest score line 12. The distance between the side 45 of wall 16 and the side 41 of hand hole 35 which is nearest the side 45 is substantially equal to the distance between score line 13 and the side 44 of hand hole 40 which is nearest score line 13.

Upper securing panel 46 is attached to the wall 17 by the score line 30. The upper securing panel 46 is divided by the score lines 11 and 12 into an upper closure panel 47 and attachment flaps 48 and 49. The attachment flap 48 is separated from the wall 16 by cut line 50, and is separated from the handle panel 31 by cut line 51. The cut lines 50 and 51 may have a circular juncture as shown or may meet perpendicularly. The attachment flap 49 is separated from the wall 18 by cut line 52, and is separated from handle panel 36 by cut line 53. The cut lines 52 and 53 may have a circular juncture as shown or may meet perpendicularly.

Upper securing panel 54 is attached to wall 19 by the score line 30. Upper securing panel 54 is divided by the score lines 13 and 14 into an upper closure panel 55 and attachment flaps 56 and 57. The attachment flap 56 is separated from the wall 18 by cut line 58, and is separated from the handle panel 36 by cut line 59. The cut lines 58 and 59 may have a circular juncture as shown or may meet perpendicularly. The attachment flap 57 is separated from the attachment panel 20 by slot 60.

In an embodiment of the invention the distance between the score line 30 and the outer side 61 of upper closure panel 47 opposite the score line 30 is less than one half the width of a side wall 16 or 18, and the distance between the score line 30 and the outer side 61 of upper panel 47 opposite the score line 30 is also less than one half the width of a side wall 16 or 18. This creates an opening in the top of the container that allows the hand holes to be grasped.

In an embodiment of the invention the distance between the score line 30 and the outer side 61 of upper closure panel 47 opposite the score line 30 is equal to or less than the distance between the score line 11 and the side 42 of hand hole 35, and the distance between the score line 30 and the outer side 62 of upper closure panel 55 opposite the score line 30 is equal to or less than the distance between the score line 13 and the side 44 of hand hole 40. This creates a space in the top of the container that allows the hand holes to be grasped.

In an embodiment of the invention the length of closure member 33, the distance between the score line 30 and score line 32, is substantially equal to the length of closure member 38, the distance between score line 30 and the score line 37. The length of closure member 33 is greater than one-half the width of the walls 17 and 19 and the length of closure member 38 is greater than one-half the width of either wall 17 or 19 so that the closure members 33 and 38 extend downwardly into the container from score line 30 when the container is closed. The handle members 34 and 39 will extend upwardly from score lines 32 and 37 and have their upper sides below or at the upper surface of the container.

In another embodiment the length of closure member 33 is not equal to the length of closure member 38. At least one of the closure members will have a length that is greater than one-half the width of end walls 17 and 19, and the combined lengths of closure members 33 and 38 will be greater that the width of either wall 17 or 19 so that the closure members 33 and 38 will extend downwardly from score line 30 into the container, and the handle members 34 and 39 will meet and extend upwardly toward the top of the container with their upper sides below or at the level of the top of the container.

In forming the container attachment panel 20 is attached to wall 16 adjacent the side 45. The attachment may be by adhesive or staples. The attachment may be on the inside or the outside of wall 16.

When the container is erected the walls 16, 17, 18 and 19 are bent outwardly around the score lines 11, 12, 13 and 14 until the walls 16 and 18 are perpendicular to the walls 17 and 19. The bottom closure panels 22, 23, 24 and 25 are bent upwardly around the score line 21. Two opposed bottom closure panels will usually be beneath the other two opposed bottom closure panels. The bottom closure panels are held in place by adhesive, staples or tape.

After the container is filled, the closure members 33 and 38 are bent downwardly around score line 30 until the closure members 33 and 38 extend into the container below the score line 30, and the handle members 34 and 39 are contiguous and extend upwardly toward the top of the container defined by score line 30.

Upper securing panels 46 and 54 are bent downwardly around score line 30 until they rest on the upper sides of walls 16 and 18 defined by score line 30. Attachment flaps 48, 49, 56 and 57 are bent downwardly around score line 30 and fastened to the walls 16 and 18. The attachment may be by adhesive or staples. The upper closure panels 47 and 55 are over the outer sides 63 and 64 of handle members 34 and 39 and hold the handle members beneath the top of the container. The outer sides 61 and 62 of the upper closure panels 47 and 55 are spaced apart and define an opening which allows the hand holes 35 and 40 to be grasped when the container is carried.

In any embodiment of the invention the Pythagorean theorem will apply in the formed container. The Pythagorean theorem is that the square of the hypotenuse of a right triangle equals the sum of the squares of the other two sides. Each of the closure members 33 and 38 will form the hypotenuse of a right triangle.

The right triangle formed by the closure member 33 would have score line 32 as one point of the triangle and score line 30 as another point of the triangle. The closure member 33 is the hypotenuse of the right triangle. The second side of the triangle is a plane parallel with wall 16 and extending toward the top of the container from score line 32. The handle panel 34 would normally be in this plane. The third side of the triangle would be the plane forming the top of the container. It would extend from the top of the wall 16 to the intersection of the top plane with the second side of the triangle formed by the plane from score line 32 parallel to walls 16 and 18.

From this it can be seen that the length of the handle member 34, the dimension from score line 32 to the outer side 63 of the handle member opposite score line 32, will depend upon the length of the closure member 33. At the handle member's maximum length, the square of the length of handle member 34 plus the square of the distance of handle member 34 from wall 16, the distance of score line 32 from wall 16, in the formed container will equal the square of the length of closure member 33.

The same calculation will apply to closure member 38, handle member 39 and wall 18.

The container may be used for liquids. It may carry a bag with a spigot. In this case it may have an opening for the spigot on one wall. Such an opening is shown on wall 17. It is at the lower end of the container. An opening panel 65 is hinged to wall 17 by a score line 66. The opening panel is defined by slit score lines 67, 68 and 69. A circular cut-out member 70 is defined by slit-score line 71. In use the opening panel 65 is pushed inwardly around score line 66, the circular cut out 70 member is taken out, the spigot is pulled outside of the container and the panel 65 is pull back into place even with the wall 17.

This provides a carrier that has a handle and that may be stacked. The upper closure panels 47 and 55 of upper securing panels 46 and 54 hold the handle formed by handle members 34 and 39 and hand holes 35 and 40 beneath the top of the container and also allow support the containers may be stacked upon the container.

Figure 3:
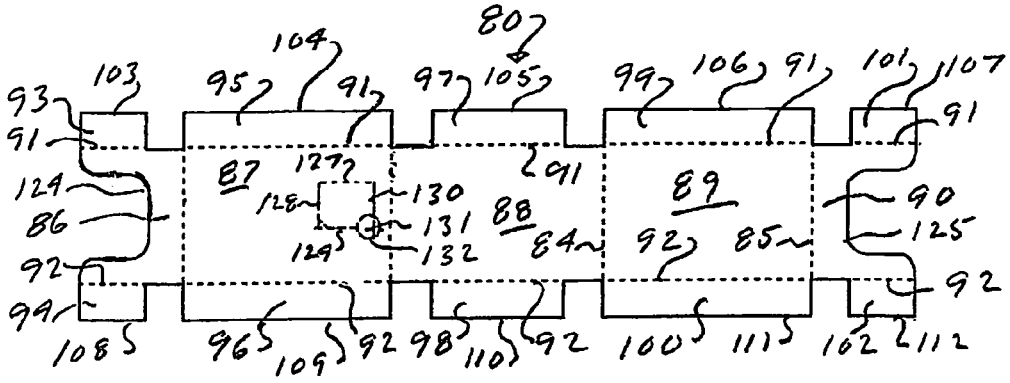
FIGS. 3 and 4 are top plan views of blanks for another embodiment of the invention.
Figure 4:
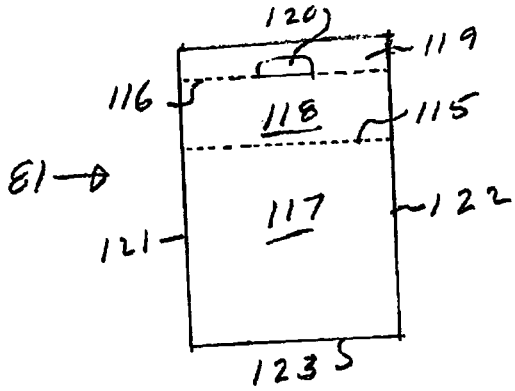
Figure 5:
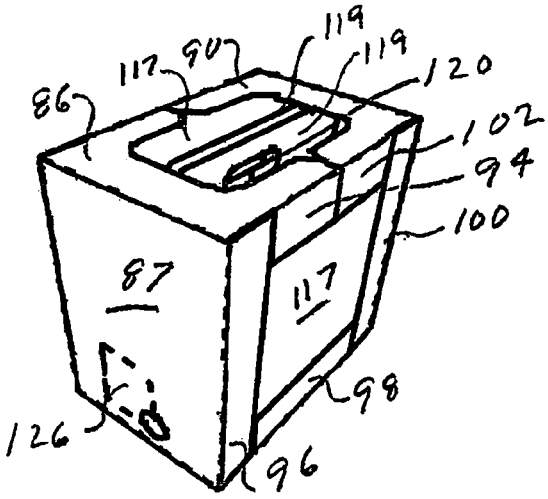
FIG. 5 is an isometric view of the container made from the blanks of FIGS. 3 and 4.

Another embodiment of the invention is shown in FIGS. 3, 4 and 5. It uses a three part blank, a body blank 80 and a pair of wall blanks 81.

The body blank 80 is divided by transverse score lines 82, 83, 84 and 85 into an upper closure panel 86, a wall 87, a bottom wall 88, a wall 89 and an upper securing panel 90. The transverse score lines 82, 83, 84 and 85 are substantially parallel. The height of wall 87, the distance between transverse score lines 82 and 83, is substantially equal to the height of wall 89, the distance between transverse score lines 84 and 85.

Longitudinal score lines 91 and 92 divide the panels and walls 86, 87, 88, 89 and 90 from the attachment flaps and members attached to each side of the panels and walls. The longitudinal score lines 91 and 92 are substantially parallel to each other and substantially perpendicular to transverse score lines 82, 83, 84 and 85. Attachment flaps 93 and 94 are attached to each side of upper securing panel 86. Attachment panels 95 and 96 are attached to each side of wall 87. Attachment panels 97 and 98 are attached to each side of bottom wall 88. Attachment panels 99 and 100 are attached to each side of wall 89. Attachment flaps 101 and 102 are on upper closure panel 90.

The attachment flap 93, attachment panels 95, 97 and 99, and attachment flap 101, respectively, have outer sides 103, 104, 105, 106 and 107. In one embodiment the outer sides are aligned and substantially parallel to score line 91. The distance between each of the outer sides 103, 104, 105, 106 and 107 and the score line 91 defines the width of each of the attachment flaps 93, the attachment panels 95, 97 and 99 and the attachment flap 101.

The attachment flap 94, attachment panels 96, 98 and 100, and attachment flap 102, respectively, have outer sides 108, 109, 110, 111 and 112. In one embodiment the outer sides are aligned and substantially parallel to score line 92. The distance between each of the outer sides 108, 109, 110, 111 and 112 and the score line 91 defines the width of each of the attachment flaps 94, the attachment panels 96, 98 and 100 and the attachment flap 102.

The attachment panels and attachment flaps on each side of the blank are separated from each other by at least the width of an attachment flap or panel. In the embodiment shown in FIG. 3, the attachment flaps 93 and 94 are separated from the attachment panels 95 and 96, respectively, by the width of the attachment panels 95 and 96 respectively. The attachment panels 97 and 98 are separated from attachment panels 95 and 96 by the width of attachment panels 95 and 96, and are separated from attachment panels 99 and 100 by the width of attachment panels 99 and 100. The attachment flaps 101 and 102 are separated from attachment panels 99 and 100 by the width of attachment panels 99 and 100.

The closure panel 86 and its attachment flaps 93 and 94 form a securing panel. The closure panel 90 and its attachment flaps 101 and 102 form another securing panel.

Each of the blanks 81 is divided by transverse score lines 115 and 116 into a wall 117, a closure member 118 and a handle member 119. The transverse score lines 115 and 116 are substantially parallel. A hand hole 120 is in the handle member. The hand hole 120 may have its inner side on the score line 116, as shown, or it may be within the handle member 119. If additional strength is required, flaps may be attached to the sides 121 and 122 of wall 117. These flaps would be inside the formed container and may be attached to the walls 87 and 89 by glue or staples.

The width of the blank 81, the distance between the sides 121 and 122 of the blank 81, is substantially equal to the distance between score lines 83 and 84 of the blank 80. Score lines 83 and 84 define the length of bottom wall 88. The wall 117 rests on the bottom wall 88 in the formed container. The height of the wall 117, the distance between the bottom side 123 of the wall 117 and score line 115, is substantially equal to the height of the walls 87 and 89.

The length of closure member 118, the distance between score lines 115 and 116, is greater than one half the width of the panels 87 and 89, the distance between score lines 91 and 92, so that the closure member 118 will extend into the formed container and the handle member 119 will extend upwardly from the closure member 118 and the top of the handle member will remain below or at the top of the formed container.

In forming the container, two blanks 81 are used. One wall 117 is attached to the bottom and side walls by attachment panels 96, 98 and 100, and another wall 117 is attached to the bottom and side walls by attachment panels 95, 97 and 99. The attachment may be by glue or staples. The closure members 118 are bent downwardly into the container until the handle members are contiguous and the hand holes are aligned. The handle members extend upwardly toward the top of the container and the upper side of the handle members will be either at the top of the container or below the top of the container.

The closure panels 86 and 90 are bent downwardly until they rest on the upper side of the container defined by score lines 115. The closure flaps are bent downwardly onto the walls 117 and fastened to the walls 117 either by glue or staples. The closure panels 86 and 90 hold the handle members in place below the top of the container. The closure panels also support another container stacked on top of the container.

There is an external cut-out section 124 in closure panel 86 and an external cut-out section 125 in closure panel 90. These cut-out sections provide an opening 126 in the upper wall that allows the hand-holes 120 to be grasped. The depth of each of the cut-out sections 124 and 125 should be at least one-half of the width of the hand holes 120.

The container may be used for liquids. It may carry a bag with a spigot. In this case it may have an opening for the spigot on one wall. Such an opening is shown on wall 87. It is at the lower end of the container. An opening panel 126 is hinged to wall 87 by a score line 127. The opening panel is defined by slit score lines 128, 129 and 130. A circular cut-out section 131 is defined by slit-score line 132. In use the opening panel 126 is pushed inwardly around score line 127, the circular cut out 131 section is taken out, the spigot is pulled outside of the container and the panel 126 is pull back into place even with the wall 87.

The Pythagorean theorem also applies to the dimensions of the closure member 118 and handle member 119 of this embodiment of the invention. Each of the closure members 118 will form the hypotenuse of a right triangle in the formed container.

The right triangle formed by the closure member 118 would have score line 116 as one point of the triangle and score line 115 as another point of the triangle. The closure member 118 is the hypotenuse of the right triangle. The second side of the triangle is a plane parallel with wall 117 and extending toward the top of the container from score line 116. The handle panel 119 would normally be in this plane. The third side of the triangle would be the plane forming the top of the container. It would extend from the top of the wall 117 to the intersection of the top plane with the second side of the triangle formed by the plane from score line 116 parallel to wall 117.

From this it can be seen that the length of the handle member 119, the dimension from score line 116 to the outer side of the handle member 119 opposite score line 116, will depend upon the length of the closure member 118. At the handle member's maximum length, the square of the length of the handle member 119 plus the square of the distance of the handle member 119 from wall 117, the distance of score line 116 from the wall 117, in the formed container will equal the square of the length of closure member 118.

Figure 6:
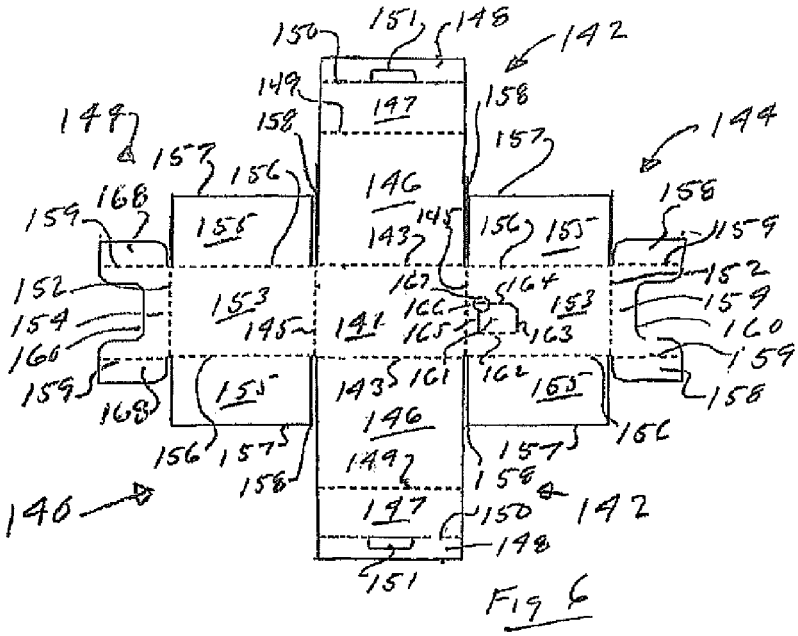
FIG. 6 is a top plan view of another embodiment of the invention.
Figure 7:
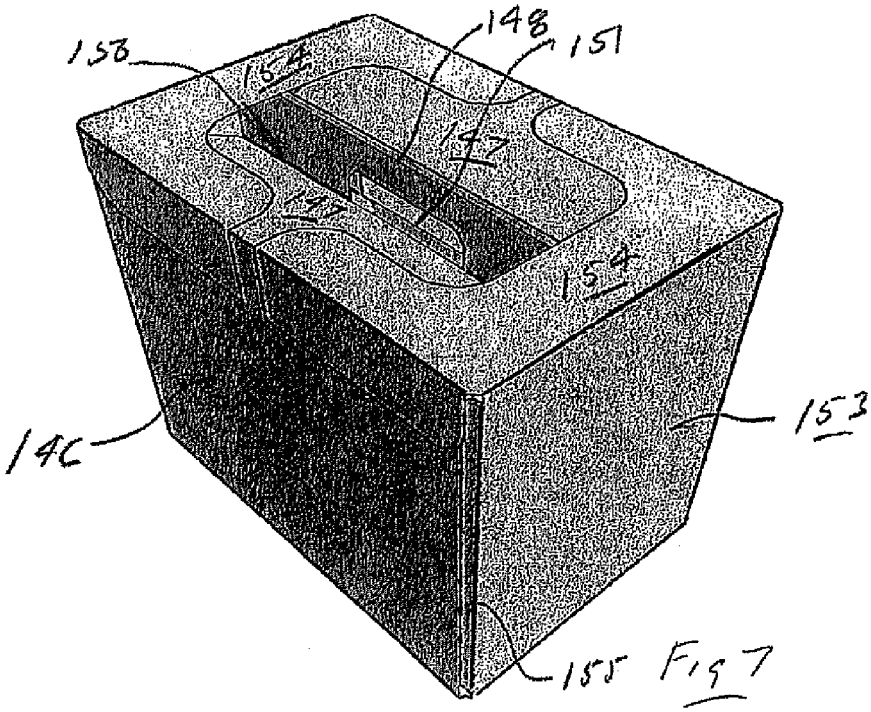
FIG. 7 is an isometric view of the container made from the blank of FIG. 6.

Another embodiment of the container and blank is shown in FIGS. 6 and 7.

The blank 140 has a bottom wall 141. A pair of panels 142 are attached to opposed sides of the bottom wall 141 by longitudinal score lines 143. A pair of panels 144 are attached to the other opposed sides of the bottom wall 141 by transverse score lines 145. The longitudinal score lines 143 are substantially parallel to each other, and the longitudinal score lines 145 are substantially parallel to each other. The longitudinal score lines 145 are substantially perpendicular to the transverse score lines 145.

Each of the panels 142 is divided into a wall 146, a closure member 147 and a handle member 148 by longitudinal score lines 149 and 150. Score lines 149 and 150 are substantially parallel to longitudinal score lines 143. There is a hand hole 151 in each of the handle members 148. The inner side of the handle hole 151 may be aligned with score line 150 or may be entirely within handle member 148. The closure member 147 and the handle member 148 form a closure panel.

In an embodiment the length of each closure member 147, the distance between score lines 149 and 150, is greater than one-half the distance between the longitudinal score lines 143 so that the closure member 147 will extend downwardly into the formed container when the two handle members 148 meet in the formed container, and the top of the handle members 148 will remain below or be at the top of the formed container.

In an embodiment the length of one of the closure members 147 is greater than one-half the distance between the longitudinal score lines 143 and the combined length of both closure members 147 is greater than the distance between longitudinal score lines 143 so that the closure member 147 will extend downwardly into the formed container when the two handle members 148 meet in the formed container, and the top of the handle members 148 will remain below or be at the top of the formed container.

Each of the panels 144 are divided by transverse score line 152 into an wall 153 and an upper closure panel 154. Score lines 152 are substantially parallel to score lines 145. The height each of the walls 153, the distance between score line 145 and score line 152 is substantially equal to the height of each of the walls 146, the distance between score lines 143 and score line 149. There may be a slight difference in heights to allow the closure panels to fold into place.

A pair of panels 155 are attached to opposed sides of each wall 153 by longitudinal score lines 156. Each of the longitudinal score lines 156 is substantially aligned with longitudinal score line 144. The longitudinal score lines 156 may be slightly transversely inwardly or outwardly of longitudinal score line 143 depending on whether panels 155 are on the inside or the outside of wall 146 in the formed container.

The panels may be attached to the sides of walls 146 instead of 153. The score lines attaching the panels to the wall would then be substantially aligned with score lines 145 and the slots 158 separating the panels 155 from the walls 153 would be substantially aligned with score lines 143.

In an embodiment, the maximum width of each side panel 155, the distance between the score line 156 and the outer side 157 of the side panel 155, is one half the distance between the pair of transverse score lines 145. The allows the outer sides of the side panels 155 to meet in the formed container.

In an embodiment requiring greater stacking strength, the width of each side panel 155 may be equal to the distance between the pair of transverse score lines 145. The offset of the longitudinal score lines would allow the wall 145 and the panels 155 to be aligned in the formed container.

Each of the panels 155 is separated from the walls 146 by slots 158. Slots 158 are aligned with transverse score lines 145.

Attachment panels 168 are attached to opposed sides of each closure panel 154 by score lines 159. Score lines 159 are aligned with score lines 156 and 143 and may be offset slightly to allow the attachment panels to close over and attach to the walls 146. The closure panel 154 and the attachment panels 168 form a securing panel.

Each of the closure panels 154 has an external cut-out section 160.

In forming the container the panels 155 are bent inwardly around score lines 156 until they are perpendicular to walls 153. The walls 153 are bent upwardly around score lines 145 until they are perpendicular to bottom wall 141. Walls 143 are bent upwardly around score lines 143 until they are perpendicular to bottom wall 141. The container is filled and closure members 147 are bent downwardly and inwardly into the container until the handle members 148 meet. The upper sides of the handle members will be at or below the top of the container. Closure panels 154 are bent downwardly around score lines 152 until they rest on the top of the container. Attachment panels 168 are bent downwardly around score lines 159 and are attached to side walls 146 by glue or staples. The closure panels 154 extend over the handle members 148 and form a support for containers placed on top of the container, allowing containers to be stacked.

The cut-out sections 160 form an opening in the top of the container. The length of the opening in the direction perpendicular to score line 152 should be at least the width of the hand hole. The width of the opening in the direction perpendicular to score lines 159 should be wide enough to allow the hand to grasp the hand hole.

The Pythagorean theorem also applies to the dimensions of the closure member 147 and handle member 148 of this embodiment of the invention. Each of the closure members 147 will form the hypotenuse of a right triangle in the formed container.

The right triangle formed by the closure member 147 would have score line 149 as one point of the triangle and score line 150 as another point of the triangle. The closure member 147 is the hypotenuse of the right triangle. The second side of the triangle is a plane parallel with wall 146 and extending toward the top of the container from score line 150. The handle panel 1148 would normally be in this plane. The third side of the triangle would be the plane forming the top of the container. It would extend from the top of the wall 146 to the intersection of the top plane with the second side of the triangle formed by the plane from score line 149 parallel to wall 146.

From this it can be seen that the length of the handle member 148, the dimension from score line 149 to the outer side of the handle member 148 opposite score line 149, will depend upon the length of the closure member 147. At the handle member's maximum length, the square of the length of the handle member 148 plus the square of the distance of the handle member 148 from wall 146, the distance of score line 149 from the wall 146, in the formed container will equal the square of the length of closure member 147.

The container may be used for liquids. It may carry a bag with a spigot. In this case it may have an opening for the spigot on one wall. Such an opening is shown on end wall 153. It is at the lower end of the container. An opening panel 161 is hinged to wall 153 by a score line 162. The opening panel is defined by slit score lines 163, 164 and 165. A circular cut-out section 166 is defined by slit-score line 167. In use the opening panel 161 is pushed inwardly around score line 162, the circular cut out 166 section is taken out, the spigot is pulled outside of the container and the panel 161 is pull back into place even with the end wall 153.

While several embodiments of the invention have been illustrated and described, it will be appreciated that various changes can be made therein without departing from the spirit and scope of the invention.

The invention claimed is:

1. A container comprising a first pair of opposed parallel walls, a second pair of opposed parallel walls, the walls forming sides of a container, the walls having substantially aligned upper sides, a closure member attached to the upper side of each of the walls in the first pair of opposed walls, the closure members extending downwardly into the container, each of the closure members having an end opposite the wall to which the closure member is attached, a handle member attached to the opposite end of each of the closure members, the handle members being contiguous, aligned hand holes in the handle members, a closure panel attached to the upper side of each of the walls in the second pair of opposed walls, the closure panels providing an opening in to allow the hand holes to be grasped, the closure panels being attached to the first pair of opposed walls, the closure members and handle members being below the closure panels, each of the closure panels having a pair of sides, an attachment flap connected to each closure panel side, and each of the first pair of opposed walls having one of the attachment flaps of each of the closure panels attached to the outer face thereof.

2. The container of claim 1 wherein the walls of the first pair of walls being spaced apart a certain distance, each closure member has a length defined by the distance between its attachment to the wall and the end opposite the attachment, one of the closure members having a length that is greater than one-half the distance between the walls of the first pair of walls, the sum of the lengths of both closure members being greater than the distance between the walls in the first pair of walls.

3. The container of claim 2 wherein both closure members have a length greater than one-half the distance between the walls of the first pair of walls.

4. The container of claim 2 wherein a plane perpendicular to the walls of the first pair of walls defines a right triangle in which each closure member forms the hypotenuse of a right triangle, a plane across the upper sides of the container forms a side of the triangle, and a plane parallel to the walls of the first pair of walls and extending through the opposite side of the closure member forms the other side of the triangle.

5. The container of claim 1 wherein the opening is formed by cut-out sections in the outer sides of the closure panels.

6. The container of claim 1 further comprising a pivotable panel in one of the walls.

7. The container of claim 1 further comprising a removable panel in one of the walls.

8. The container of claim 1 further comprising a bottom closure comprising bottom closure panels connected to each of the walls in the first and second pairs of walls.

9. The container of claim 1 further comprising a bottom wall, the walls of one of the pairs of walls are attached to the bottom wall by score lines.

10. The container of claim 9 wherein the walls of the other pair of wails are attached to the bottom wall by score lines.

11. The container of claim 9 further comprising the walls of the pairs of walls having sides, wall panels attached to the sides of the walls of one of the pairs of walls, the wall panels being inside the container.

12. The container of claim 11 wherein the wall panels have sides that meet in the container.

13. The container of claim 11 wherein the wall panels overlap in the container.

14. The container of claim 9 further comprising the walls of the other pair of walls are attached to the walls of the first pair of walls and to the bottom wall by attachment panels.

* * * * *